United States Patent [19]

Fetsko

[11] Patent Number: 4,626,358

[45] Date of Patent: Dec. 2, 1986

[54] LIQUID SWEEPING ASSEMBLY AND METHOD

[76] Inventor: Francis E. Fetsko, 1408 SE. 27th St., Cape Coral, Fla. 33904

[21] Appl. No.: 662,087

[22] Filed: Oct. 18, 1984

[51] Int. Cl.[4] ..... C02F 1/40; E02B 15/00

[52] U.S. Cl. ..... 210/776; 210/242.3; 210/767; 210/923; 210/805; 15/1.7; 134/167 R; 261/120

[58] Field of Search ..... 210/169, 416.1, 242.1, 210/242.2, 242.3, 805, 776, 767, 923, 924; 4/490; 15/1.7; 134/24, 34, 166 R, 167 R, 168 R; 137/625.68; 239/229; 261/120, 88

[56] References Cited

U.S. PATENT DOCUMENTS

| | | | |
|---|---|---|---|
| 3,032,044 | 5/1962 | Pansini | 210/169 |
| 3,067,879 | 12/1962 | Baker | 137/398 |
| 3,195,726 | 7/1965 | Sauronman et al. | 137/625.68 |
| 3,291,145 | 12/1966 | Arneson | 134/167 R |
| 3,315,692 | 4/1967 | Arneson | 239/229 |
| 3,567,025 | 3/1971 | Gillette | 210/169 |
| 3,575,729 | 4/1971 | Howard | 134/168 R |
| 3,756,578 | 9/1973 | McGure | 210/242.2 |
| 3,860,518 | 1/1975 | Henrickson | 134/34 |
| 3,928,202 | 12/1975 | Raubenheimer | 210/169 |
| 3,972,339 | 8/1976 | Henkin et al. | 210/169 |
| 4,105,557 | 8/1978 | Weatherholt | 210/169 |
| 4,154,679 | 5/1979 | Farage | 210/169 |
| 4,436,675 | 3/1984 | Hisao et al. | 261/120 |
| 4,448,689 | 5/1984 | von Nordenskjold | 261/120 |

*Primary Examiner*—Andrew H. Metz
*Assistant Examiner*—Sharon T. Cohen
*Attorney, Agent, or Firm*—Neil F. Markva

[57] ABSTRACT

The sweeping assembly performs the method of drawing impurity-laden liquid from a reservoir throughout the depth of a body of liquid. The assembly comprises a flotation section, a surface skimming section, an intermediate suction section, and a bottom sweep and suction section. The flotation section includes a floating assembly which supports the surface skimming section, the intermediate depth suction section and the bottom sweep and suction section therebelow within the liquid in the reservoir. The surface skimming section includes a mechanism for removing impurity-laden liquid from the surface of the liquid in the reservoir. The bottom sweep and suction section includes a mechanism for placing impurities from the bottom of the reservoir into suspension within the liquid body for drawing impurity-laden liquid from the bottom of the reservoir. The intermediate depth suction section includes an assembly for drawing impurity-laden liquid from an intermediate location within the liquid body at least from the middle half section between the top surface and the bottom of the liquid body.

22 Claims, 10 Drawing Figures

LIQUID SWEEPING ASSEMBLY AND METHOD

FIELD OF THE INVENTION

This invention relates to an assembly and method for sweeping impurity-laden liquid contained in a reservoir and directing that liquid into a conventional filtration system. More particularly, the invention is directed to a liquid sweeping assembly for removing impurity-laden water from a swimming pool having impurities in suspension and directing such water into the filtration system for the swimming pool.

BACKGROUND OF THE INVENTION

There are numerous devices available for taking impurity-laden liquid from a reservoir such as a swimming pool and directing same into a conventional filtration system. The impurities are removed from the liquid within the filtration system and returned to the reservoir.

There is a wide distribution of contaminants in the body of liquid contained in a reservoir such as a swimming pool. Impurities such as silt, pollen, debris and the like contaminate the water in a swimming pool and settle on the surface of the water and on the side walls and bottom of the reservoir. Many of the impurities go into suspension because of the specific gravity of the contaminant and the agitation caused by the constant circulation of the water within the swimming pool system.

Known systems and assemblies are useful in dealing with the contamination located on the surface of the body of liquid and also on the bottom of the reservoir. Such systems are disclosed in the following United States Letters Patent.

U.S. Pat. No. 2,191,027
U.S. Pat. No. 3,032,044
U.S. Pat. No. 3,067,879
U.S. Pat. No. 3,074,078
U.S. Pat. No. 3,195,726
U.S. Pat. No. 3,291,145
U.S. Pat. No. 3,315,692
U.S. Pat. No. 3,567,020
U.S. Pat. No. 3,575,729
U.S. Pat. No. 3,860,518
U.S. Pat. No. 3,926,667
U.S. Pat. No. 3,928,202
U.S. Pat. No. 3,972,339
U.S. Pat. No. 4,105,557
U.S. Pat. No. 4,154,679
U.S. Pat. No. 4,289,155

Several of these patents disclose methods of using pressure sweeps anchored in place or supported by floats to draw impurity-laden liquid out of a swimming pool. Sweep hoses anchored at the surface of the body of liquid results in a jetting action being directed downwardly which hinders impurities from reaching the surface of the body of liquid. This, of course, is detrimental to the efficiency of such surface related systems.

The known sweeping assemblies used with standard filtration systems are highly susceptible to induced back-pressure within the filtration system. Surface skimming systems using basket-type screens used to entrap impurities by wave action or propelling motion within the body of liquid will not filter out buoyant micron size impurities. Furthermore, such known systems do not have a satisfactory mechanism for overcoming the built-in back-pressure problem associated with the conventional filtration systems used with swimming pools.

Some of the known assemblies use separate booster pumps to apply force for propelling motorized systems. Such a booster pump may be connected to the return side of a filter to thereby provide a source of supply for generating pressure therein. The siphoning effects of a booster pump are strong enough to divert the volume of liquid away from the standard filtration system return and thereby the skimming effectiveness of the overall system is reduced.

While there are numerous systems available to remove impurities from a body of liquid, none are able to accomplish the specific results achieved in the present application. All of the disadvantages of the prior art systems as disclosed herein are readily overcome by the invention as disclosed and described herein.

PURPOSE OF THE INVENTION

The primary object of this invention is to provide a liquid sweeping assembly that is effective to remove contamination in suspension at the surface, at the bottom and from any position at an intermediate depth between the top surface and bottom of a body of liquid contained in the reservoir.

Another object of the invention is to provide a method and means for satisfactorily skimming impurity-laden liquid from the surface of the body of liquid without being adversely affected by back-pressure within the conventional filtration system to which the assembly is attached.

A further object of the invention is to provide a liquid sweeping assembly which includes means for putting impurities disposed on the sides and bottom of the reservoir into suspension so that the impurity-laden material may be taken from the body of water and directed into a conventional filtration system.

A still further object of the invention is to provide a nonelectrical, liquid sweeping assembly which integrates pressure, vacuum and flotation systems into a single, compact unit which operates in conjunction with a conventional filtration system for a swimming pool.

Another object of the invention is to provide a liquid sweeping assembly having the facility to draw impurity-laden material from a location at an intermediate depth between the top surface and bottom of the body of liquid within a reservoir into a conventional filtration system of a swimming pool.

SUMMARY OF THE INVENTION

The sweeping assembly is used to perform the method of drawing impurity-laden liquid from a reservoir holding a body of such liquid. The method comprises the steps of causing the impurities to be maintained in suspension within the liquid and then removing the impurity-laden liquid from a location intermediate the top surface and bottom of the liquid in the reservoir. In the specific embodiment, the impurity-laden liquid is removed from the top surface and at the bottom of the liquid at the same time that such liquid is removed from at least the middle half section between the top surface and bottom of the liquid. The assembly comprises the specific means for accomplishing the method of the invention.

A particular feature of the invention is directed to a sweeping assembly comprising a flotation section, a surface skimming section, an intermediate suction section, and a bottom sweep and suction section. The flotation section includes floating means for supporting the surface skimming section, the intermediate depth suction section and the bottom sweep and suction section therebelow within the liquid in the reservoir.

The surface skimming section includes means for removing impurity-laden liquid from the surface of the liquid with the intermediate depth suction section including means for drawing impurity-laden liquid from an intermediate location within the liquid body between the top surface and the bottom of the reservoir. The bottom sweep and suction section includes means for placing impurities from the bottom of the reservoir in suspension within the liquid body.

A particular feature of the invention is directed to the housing means disposed around the surface skimming section and intermediate depth suction section while including means for connecting the assembly to a filtering means. The reservoir is a swimming pool and the intermediate suction section includes valve means for maintaining a suction balance between the assembly and filtration and drain system of the swimming pool. The intermediate suction section is effective to remove impurity-laden liquid from at least the middle half section between the top surface and the bottom of the swimming pool.

A further feature of the invention is directed to the bottom sweep and suction section which includes means for connecting the assembly to a pressurized source of fluid material. Furthermore, the bottom sweep section includes means for stabilizing the assembly within the body of liquid in the reservoir. The assembly has a longitudinal axis which extends downwardly from the floating means and the stabilizing means includes plate means which extends outwardly in a direction normal to the longitudinal axis. Each of a plurality of connectors is coupled to a flexible sweep hose with the connectors being further coupled to the stabilizing means. The stabilizing means also includes a ballast tank means located at the bottom suction section of the assembly to contain liquid for providing stability to the assembly while floating in the body of liquid.

A further feature of the invention is directed to the flotation section which includes a platform means extending outwardly from and transverse to the longitudinal axis of the assembly. The floating means includes a plurality of hollow float members extending downwardly from the platform means. The bottom portion of the platform means includes support sleeves having an abutment on the inside thereof to contact a float member rotatably mounted therein. Each float member has a cambered edge communicating with the support sleeve abutment means and is effective to adjust the position of each float member with respect to the platform means upon rotation of the float member within the support sleeve.

A still further feature of the invention is directed to a specific embodiment of the surface skimming section which includes a skimmer tank means and a floating weir member rotatably disposed in the skimmer tank means. The floating weir member is effective to promote a secondary surface level within the skimmer tank means and includes means for allowing liquid to flow from the body of liquid in the reservoir into the skimmer tank means. The weir member includes means for causing rotation thereof within the tank means as the liquid flows into the tank means.

The floating weir member of the specific embodiment includes a centrally located float portion providing buoyancy within the skimmer tank means and an annular flange member radially spaced from the central float portion. The flange member is effective to extend over the circumferential edge of the skimmer tank means. The action of the weir member is effective to maintain a differential surface level between the secondary surface in the skimmer tank means and the surface of the liquid body in the reservoir in which the assembly is disposed. The weir member is also effective to preclude aeration of the intermediate suction section by maintaining a constant prime within the skimmer tank means. A means for controlling the upward movement of the weir member within the skimmer tank means is located in the flotation section.

The weir member includes offset openings circumferentially placed around the upper edge of an outer annular wall. Each of the cavities has an access indentation extending in a direction transverse to the radius of the weir member and is effective to allow for uniform flow of liquid from outside the weir member into the skimmer tank means. The movement of liquid through the cavity access indentations is effective to rotate the floating weir member continuously thereby maintaining weir balance and oscillatory action of the weir member thereby preventing hang-up thereof.

A further feature of the specific embodiment includes housing means defining the surface skimming section and the intermediate depth suction section. The skimmer tank means includes means for adjusting the vertical position of the tank means with respect to the housing means which connects to the flotation section and extends downwardly therefrom. The skimmer tank means has openings located therein to direct liquid from the surface skimming section to the intermediate depth suction section. The skimmer tank means includes means for adjusting the size of the openings innerconnecting the skimmer tank means and the intermediate depth suction section. The skimmer tank means also includes chambered, T-connector means having aperture means for directing liquid from the skimmer tank means into the intermediate suction section and is effective to control the operation of the weir surface skimming section. The housing means also includes means for adjusting the length of the suction section between the top surface and the bottom of the body of liquid in the reservoir.

BRIEF DESCRIPTION OF DRAWINGS

Other objects of this invention will appear in the following description and claims, reference being made to the accompanying drawings forming a part of the specification wherein like reference characters designate corresponding parts in the several views.

DETAILED DESCRIPTION

Figure 1:
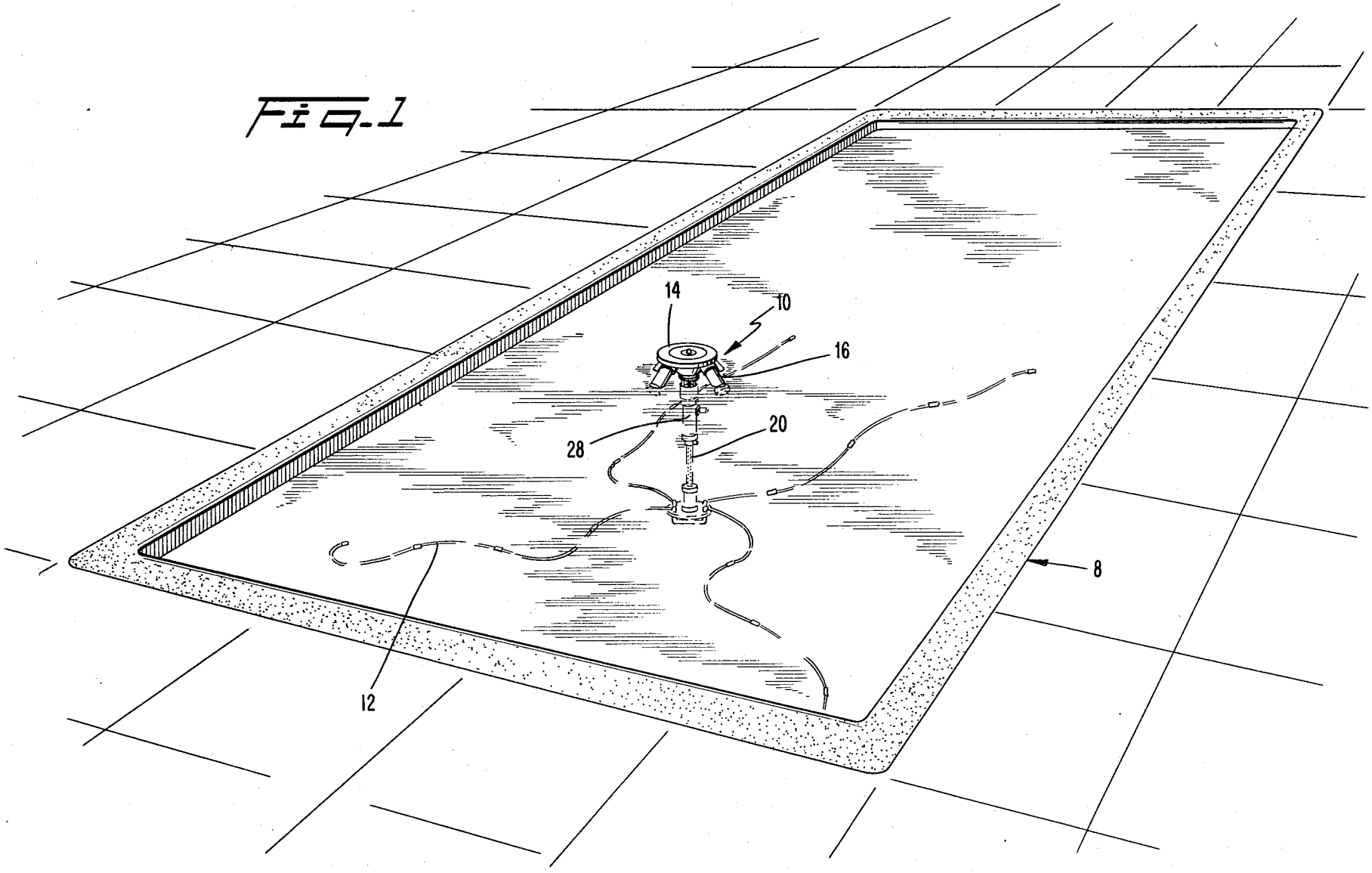
FIG. 1 is a perspective view of a sweeping assembly made in accordance with this invention as disposed in a swimming pool.
Figure 2:
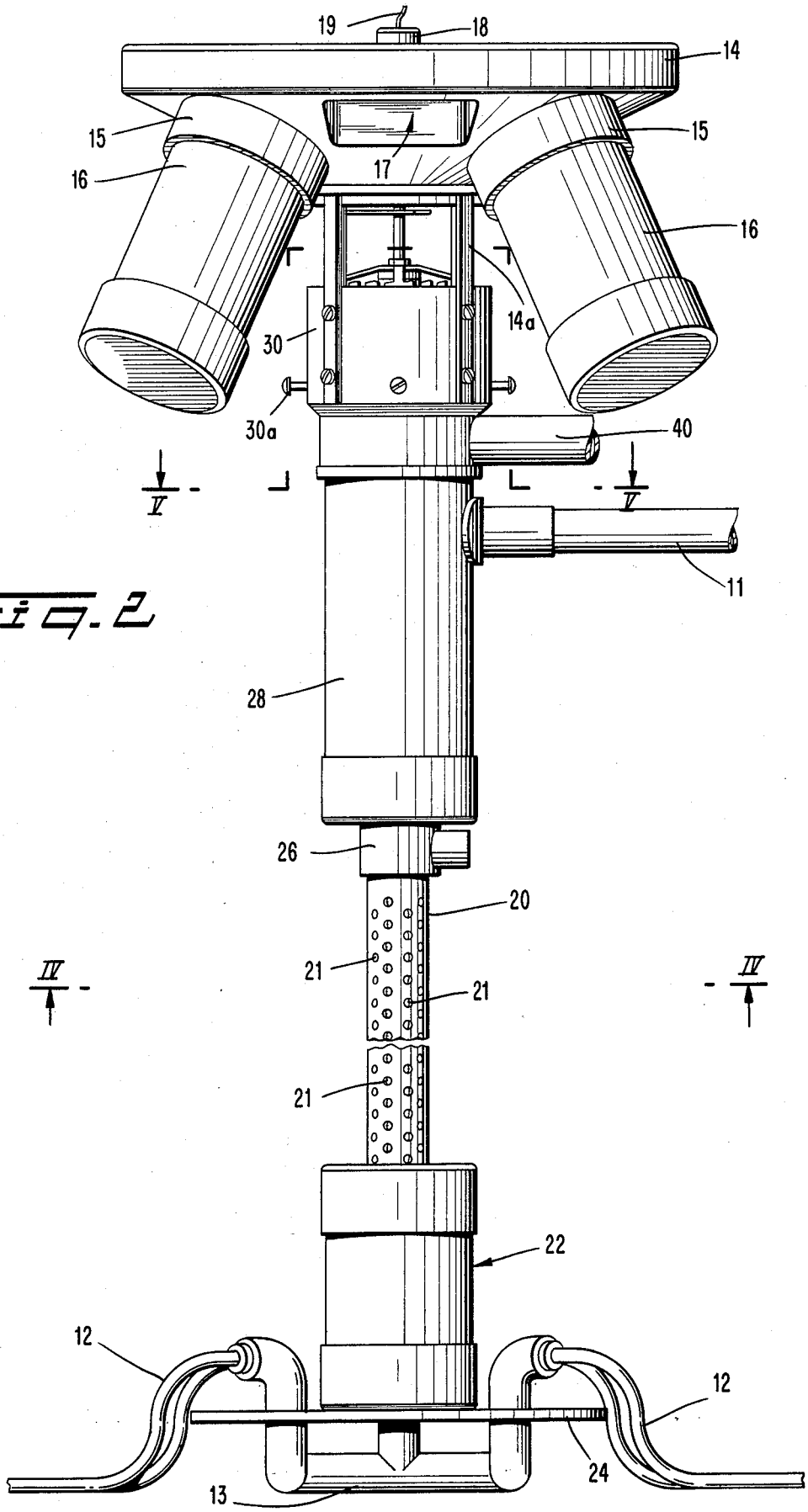
FIG. 2 is a side elevational view of a sweeping assembly as shown in FIG. 1.
Figure 3:
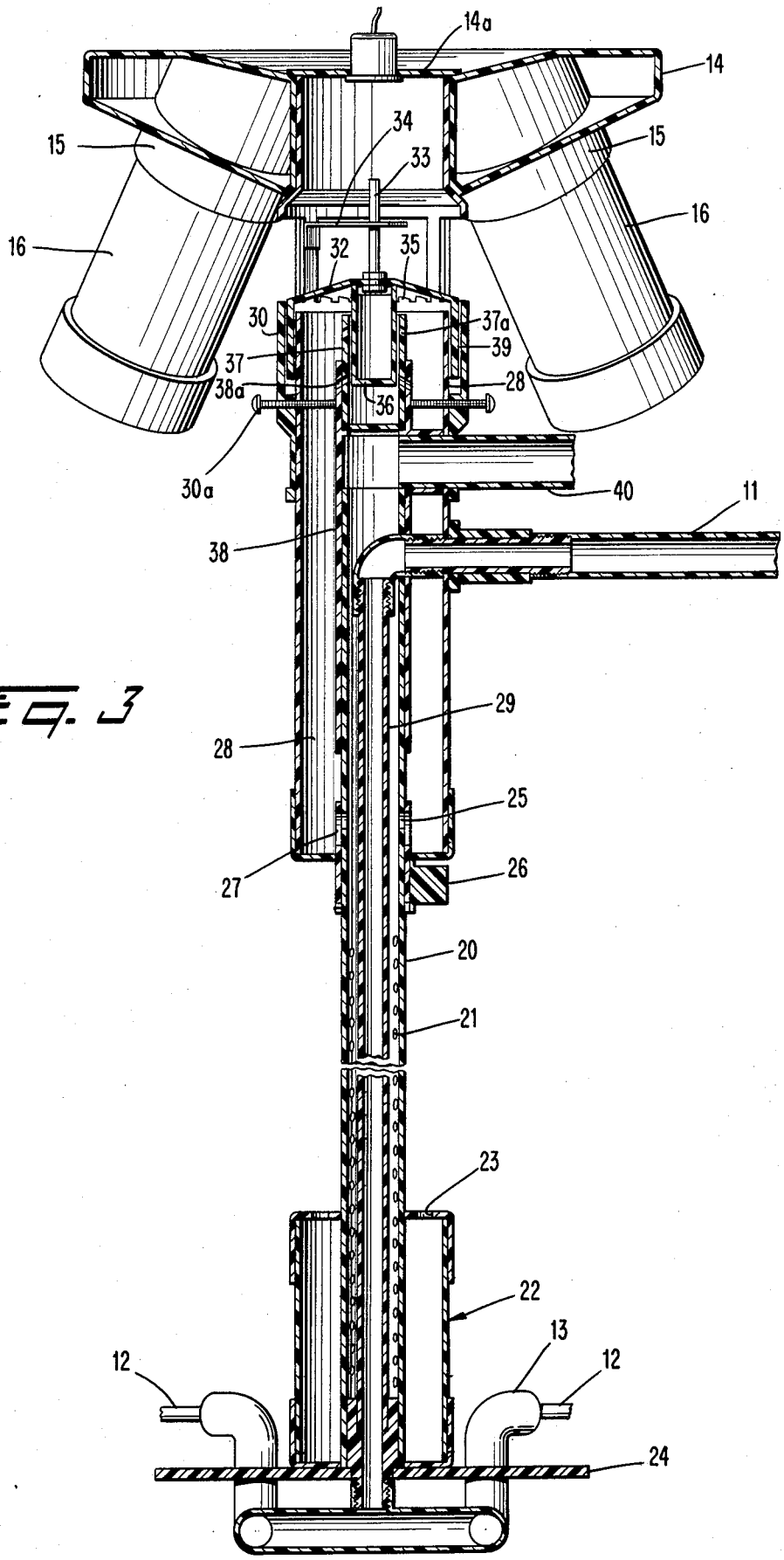
FIG. 3 is a cross-sectional view along the longitudinal axis of the assembly as shown in FIG. 2.
Figure 4:
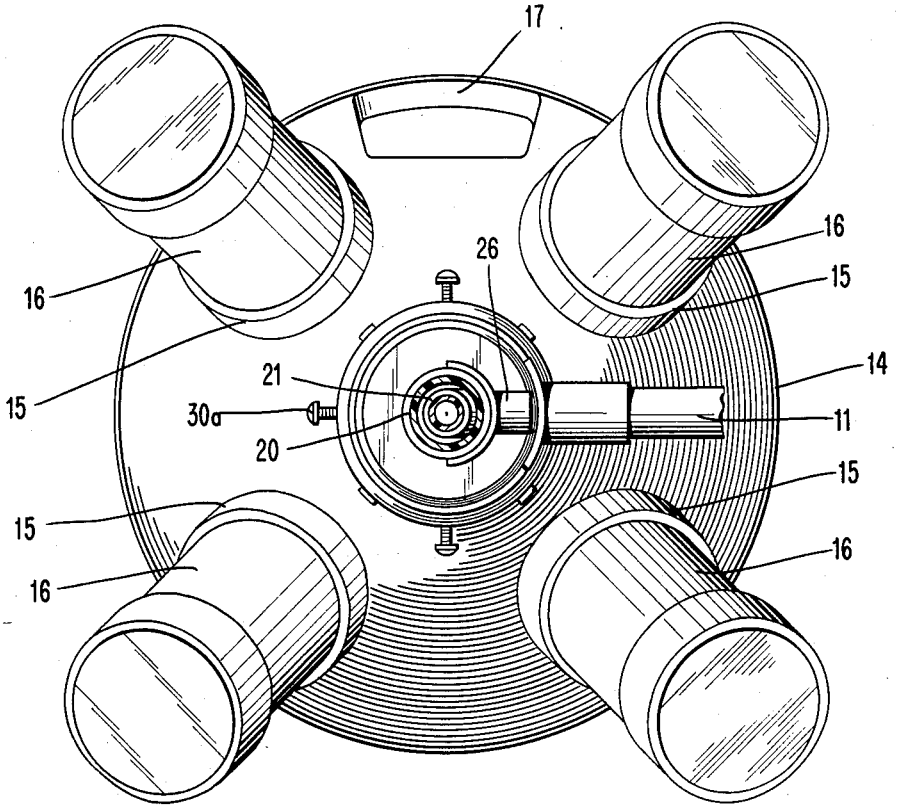
FIG. 4 is a sectional view along line IV—IV of FIG. 2.
Figure 5:
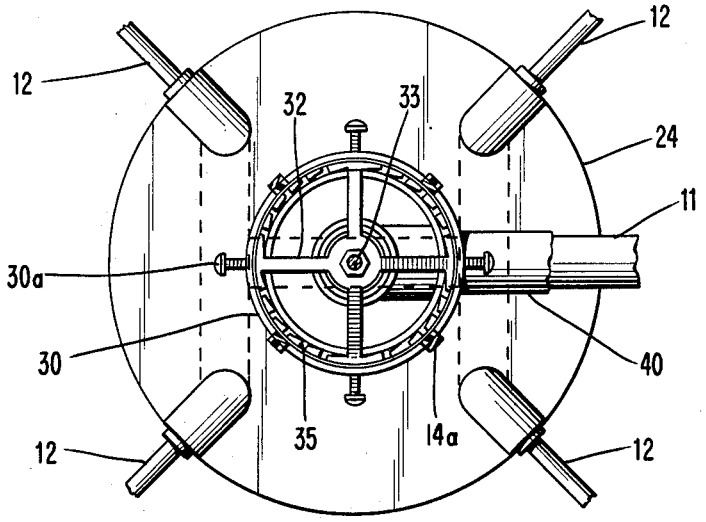
FIG. 5 is a sectional view along line V—V of FIG. 2.

The liquid sweeping assembly 10 is floatingly disposed in the swimming pool 8 as shown in FIG. 1. The flotation platform section 14 maintains the assembly 10 in an upright position with the sweeping members 12 moving across the bottom of the swimming pool 8 to cause impurities to become suspended as liquid is forced from the filtration system into the bottom of the pool. The intermediate suction section 20 insures the removal of impurity-laden liquid from a location intermediate the top surface and the bottom of the liquid in the swimming pool 8.

In this particular embodiment, impurity-laden liquid is removed from the top surface and at the bottom of the swimming pool at the same time that such liquid is removed from at least the middle half section between the top surface and the bottom of the liquid. That is, the middle half section is that portion of the swimming pool 8 that includes the center of the swimming pool at its center. The bottom and top ends of the middle half section are one-quarter of the distance from the bottom and top surface of the swimming pool 8, respectively.

Figure 6:
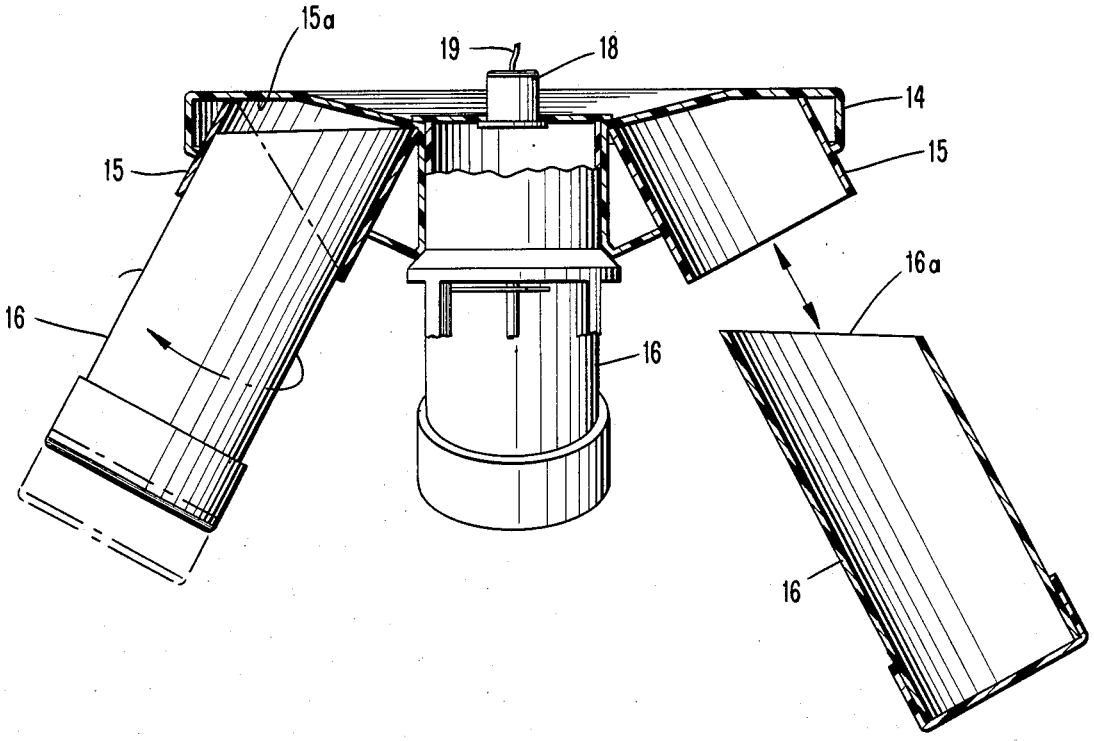
FIG. 6 is a fragmentary sectional view through the flotation section of an assembly made in accordance with this invention.
Figure 7:
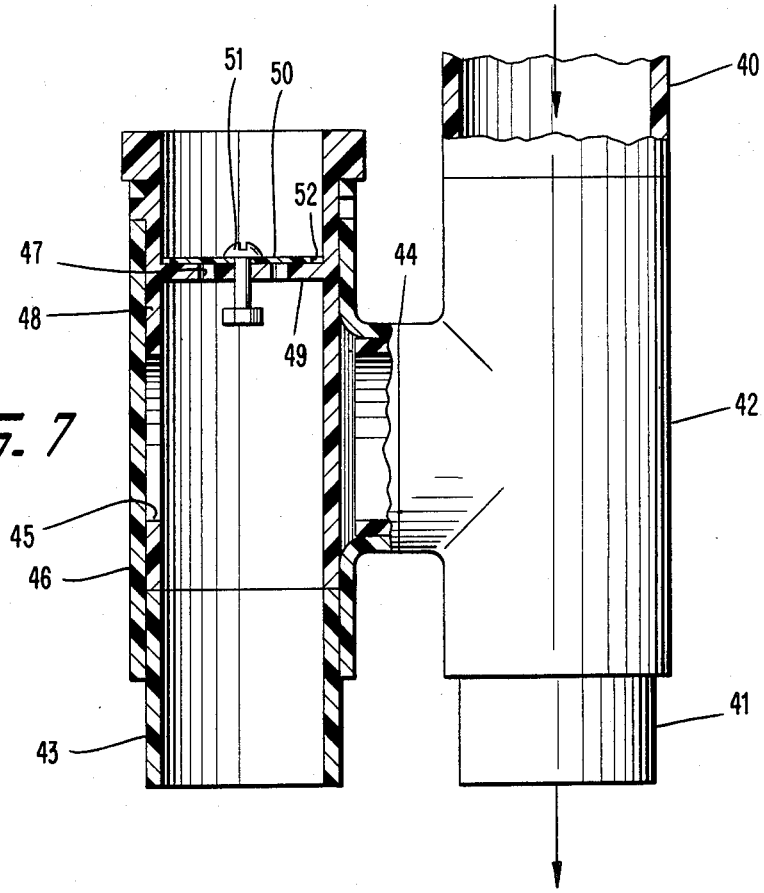
FIG. 7 is a fragmentary sectional view of a valve assembly used for controlling the flow of liquid through the sweeping assembly shown in a closed position.

The flotation platform section 14 has a plurality of hollow float members 16 which extend downwardly from support means 15 having an abutment on the inside thereof to contact the float member 16 rotatably mounted therein. See particularly FIG. 6. Each float member 16 has a cambered edge 16*a* communicating with the support sleeve abutment means 15*a*. Thus, the position of each float member 16 may be adjusted with respect to the platfom means 14 upon rotation thereof within the support sleeves 15.

A connector 18 is centrally located in platform hub portion 14*a* and has a tether line 19 connected thereto for changing the location of assembly 19 within the swimming pool 8. Hub portion 14*a* extends downwardly and is secured to housing 30 as shown. Platform 14 also includes an opening 17 acting as a handle for transporting the assembly 10.

The assembly 10 comprises a flotation section, a surface skimming section, an intermediate suction section and a bottom sweep and suction section. Housing 30 and hub portion 14*a* together define the surface skimming section. A weir member 32 maintains a certain level with respect to the surface of the pool 8. In a static position with the vacuum off on the filtration system, weir member 32 will float upwardly because suction tank 28 will be filled or flooded. Float portion 36 provides buoyancy within the skimmer float tank 37. The annular flange member 39 radially spaced from the central float portion 36 is effective to extend over the circumferential edge of the skimmer suction tank 28.

Suction line 40 is connected to the inlet of the pool filtration system. As the suction is drawn down, water within skimmer suction tank 28 is drawn through the openings 25, 27 located at the bottom of suction tank 28. Water moves out of the skimmer float tank 37 so that a secondary level is established within float tank 37 as water discharges through openings 37*a* and 38*a* into suction tank 28. Thus, weir member 32 necessarily moves downwardly as float 36 is buoyantly supported by the level of water in float tank 37 in skimmer tank housing 30.

Thus, the action of the weir member 32 is effective to maintain a differential surface level between the secondary surface in skimmer float tank 37 and the surface of the liquid body in the reservoir in which the assembly 10 is disposed. Weir member 32 is effective to preclude aeration of the intermediate suction section by maintaining a constant prime within the skimmer suction tank 28.

A centerpost 33 extends upwardly from weir member 32 and through an opening in the bracket 34 extending inwardly from hub portion 14*a*. Centerpost 33 is slidingly and rotatably disposed within the opening of bracket 34. Thus, the location of weir member 32 is maintained in alignment with the longitudinal axis of assembly 10 as the level of water is changed within skimmer float tank 37. Again, the secondary level of the water within tank 37 is controlled by discharging water through openings 37*a* and 38*a* as suction of the filtration system is drawn through suction line 40. Skimmer tank housing 30 is spaced radially from float tank 37 and a central suction section 38 via adjustment screws 30*a* as shown.

As the filtration system vacuum exhausts liquid from the surface skimming section, weir member 32 will move downwardly allowing liquid to flow over the top edge of annular flange wall member 39. Weir member 32 includes offset openings 35 circumferentially spaced around the upper edge of outer annular wall member 39. Each offset opening 35 comprises an access indentation extending in a direction transverse to the radius of weir member 32. Such offset openings or indentations 35 are effective to allow for a uniform flow of liquid from outside weir member 32 into suction tank 28 from the surface of the body in which the assembly 10 is floating. The movement of liquid through the cavity access indentations 35 is effective to continuously rotate floating weir member 32 for maintaining weir balance and oscillatory motion thereby preventing hang-up thereof.

As the liquid flows over the edge of weir member 32 and into tank 28, it acts as a regulator and will maintain a balance between the surface level in the reservoir and establish a level within the skimmer float tank 37. Any time there is a fluctuation in the level of the water within float tank 37, weir member 32 will move upwardly and downwardly. Thus, if someone is swimming in the pool and kicking or otherwise making waves, weir member 32 will move upwardly and downwardly to make sure that the necessary adjustment is made. Bobbing of the assembly 10 in an actively moving swimming pool is fully stabilized by action of weir member 32 as noted.

Float assembly 10 floats in the swimming pool so that weir member 32 is operative with the access indentations 35 about an inch below the surface of the water. Adjustment mechanism 26 is rotatably mounted around the center portion 20 and controls the amount of suction drawn through openings 25,27. Thus, with adjustment mechanism 26, the amount of liquid drawn through the skimmer suction tank 28 is carefully controlled. Central suction section 28 is disposed around the liquid discharge chamber section 20 and forms the discharge chamber through which the impurity-laden liquid flows to line 40. Central suction section 38 also supports float tank 37 at the top end thereof as shown.

Skimmer suction tank 28 carries the liquid from over its own top edge and the skimmer tank 37 downwardly through the openings 25, 27 into the exhaust or suction line 40. The intermediate depth suction section is defined by the liquid discharge chamber housing or section 20 having openings 21 extending therethrough and located all the way down to the bottom of assembly 10. Openings 21 draw impurity-laden liquid from the intermediate location within the swimming pool and discharges it through vacuum line 40 into the swimming pool filtration system.

A stabilizer plate 24 is located at the bottom of assembly 10 and supports ballast tank 22 having openings 23 through which impurity-laden liquid is drawn directly from the bottom of swimming pool 8. Ballast tank 22 when filled with liquid provides stability to assembly 10 while floating in the body of liquid with plate 24 adding to the stabilizing function. Plate 24 extends outwardly in a direction normal to the longitudinal axis of assembly 10.

The incoming pressurized line 11 carries filtered liquid from the filtration system downwardly through the central tube 20 to the plurality of connectors 13 connected to flexible sweep hoses 12. Connectors 13 securely are coupled to the stabilizing plate 24. As the pressurized fluid moves through the pressure line 11 and out the bottom of the swimming pool are caused to go into suspension. The resultant impurity-laden liquid is then drawn directly into the intermediate suction section along the entire length of liquid discharge chamber section 20.

The assembly of the present application performs a method of removing impurities from the swimming pool by causing the impurities to be maintained in suspension within the liquid. The overall length of the assembly is about 52 inches. The inside diameter of suction tank 28 is about 4 inches and the diameter of liquid discharge section 20 is about 1½ inches. The flexible hose sweeps 12 are known and of a standard size as used with bottom sweeping assemblies. The normal depth for a swimming pool varies from about 3 to 8 feet deep. The unit of this specific embodiment is designed to operate efficiently in swimming pools having depths within this range.

The impurity-laden liquid is removed from a location intermediate the top surface and the bottom of the liquid in the reservoir. More specifically, the impurity-laden liquid is removed from the top surface and the bottom of the liquid at the same time that such liquid is removed from at least from the middle half section between the top surface and the bottom surface of the liquid body.

Referring to FIGS. 7–10, an H-shape selector valve adaptor is connected between the vacuum line 40 and the filtration system of the swimming pool. This adapter is used in combination with the floor drain and the filtration line leading to the filter pump of the pool filter system. Use of the adapter valve establishes a vacuum or suction balance between the filtration pump and the pool drain. The arrows show liquid flow under open and closed positions.

That is, suction line 40 is connected to one end of the filter pump adapter section 42 with the other end 41 thereof connected to the line leading to the pump for the filtration system. The end 43 of the drain adapter section 46 is directly connected to the drain of the swimming pool so that impurity-laden liquid going into the pool drain may be diverted through the valve adapter when the opening 45 is rotated for registry with the channel 44 going into filter pump adapter section 42. See FIG. 8 where section 48 has been rotated to an open position.

Figure 8:
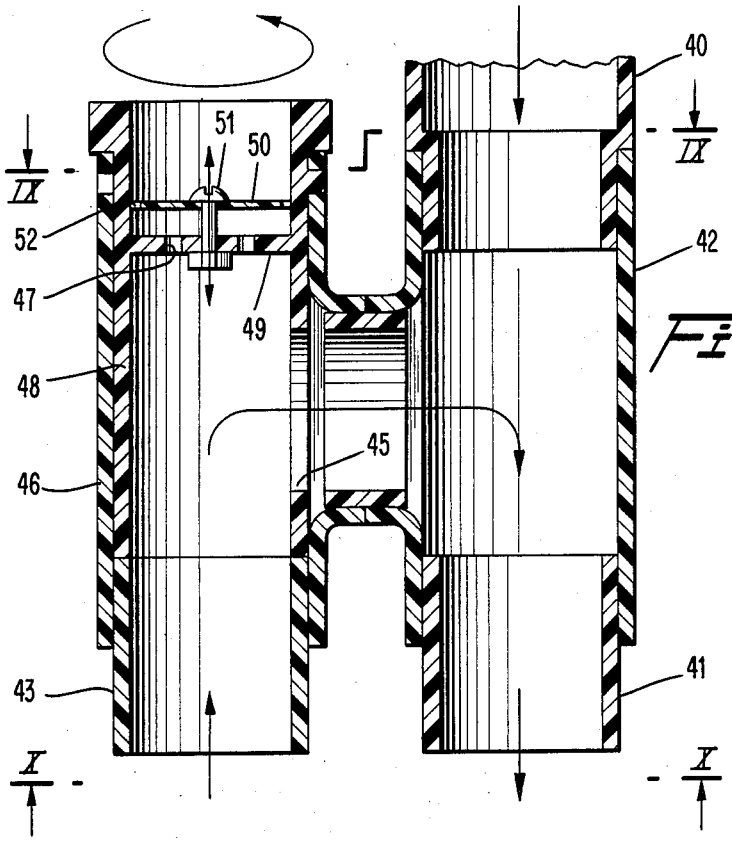
FIG. 8 is a sectional view of the valve mechanism of FIG. 7 shown in an open position.
Figure 9:
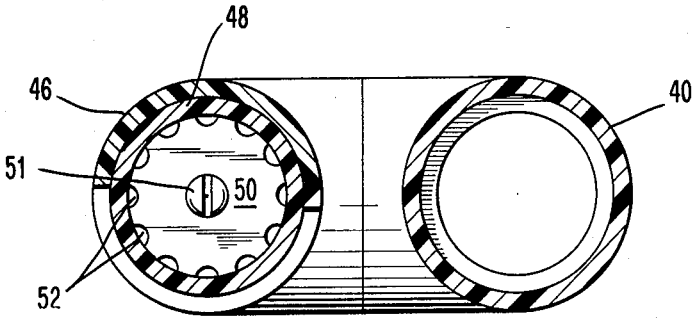
FIG. 9 is a sectional view along line IX—IX of FIG. 8.
Figure 10:
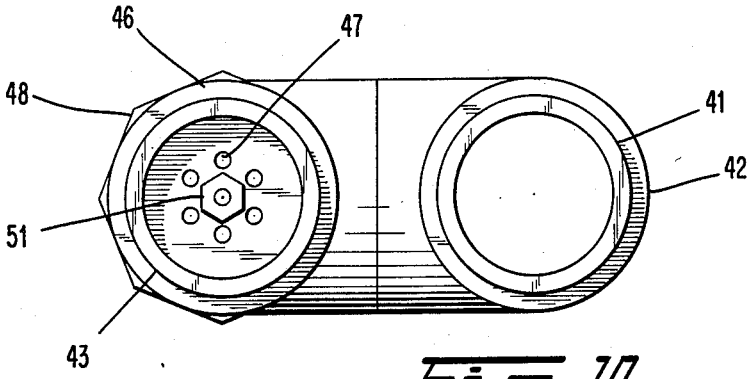
FIG. 10 is a plan view along line X—X of FIG. 8.

A relief valve is located in rotatable section 48 and the other end of drain adapter section 46. Thus relief valve is shown closed in FIG. 7 and open in FIG. 8. This relief valve comprises a disc member 50 fixedly mounted on bolt 51 for movement with respect to the valve support web 49 integrally formed with rotatable adapter section 48. When open as shown in FIG. 8, peripheral openings 52 in disc member 50 and apertures 47 in support web 49 provide a liquid flow path into and through adapter section 42.

Bolt 51 threadingly engages support web 49 so that relative movement with disc member 50 is effected by turning bolt 51. The distance of movement is limited by the abutment means at the distal end of bolt 51. Such relief valve is used to prevent back pressure being generated by sudden pump stoppage and to assure readjusted conditions upon restarting the filter pump.

While the liquid sweeping assembly and method has been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A sweeping assembly for drawing impurity-laden liquid from a reservoir holding a body of such liquid, said assembly comprising:

(a) a flotation section, a surface skimming section, an intermediate suction section and a bottom sweep and suction section, (b) the flotation section including floating means for supporting the surface skimming section, the intermediate depth suction section and the bottom sweep and suction section therebelow within the liquid in said reservoir, (c) the surface skimming section including means for removing impurity-laden liquid from the surface of the liquid in said reservoir, (d) the bottom sweep and suction section including means for placing impurities from the bottom of said reservoir in suspension within said liquid body, (e) the intermediate depth suction section including means for drawing impurity-laden liquid from an intermediate location within said liquid body between the top surface and the bottom of the reservoir, (f) means for directing said impurity-laden liquid from the surface skimming section, the intermediate depth suction section and the bottom sweep and suction section to a filtering means for extracting said impurities from the liquid which is returned to said reservoir.

2. An assembly as defined in claim 1 wherein the bottom sweep and suction section includes means for stabilizing the assembly within the body of liquid in said reservoir.

3. An assembly as defined in claim 2 wherein the bottom sweep and suction section includes a plurality of connectors with each connector coupled to a flexible sweep hose, said connectors being securely coupled to the stabilizing means.

4. An assembly as defined in claim 2 wherein said stabilizing means includes a ballast tank means located at the bottom of the assembly to contain liquid for providing stability to the assembly while floating in the body of liquid.

5. An assembly as defined in claim 1 wherein the assembly has a longitudinal axis extending from the top to the bottom thereof, and the flotation section includes a platform means extending outwardly from and transverse to the longitudinal axis, said floating means includes a plurality of hollow float members extending downwardly from the platform means.

6. An assembly as defined in claim 1 wherein housing means is disposed around the surface skimming section and intermediate depth suction section and said housing means includes means for connecting the assembly to the filtering means.

7. An assembly as defined in claim 1 wherein the bottom sweep and suction section includes means for connecting said assembly to a pressurized source of fluid material.

8. An assembly as defined in claim 1 wherein housing means defines said surface skimming section and said intermediate depth suction section, said surface skimming section includes a skimmer tank means having means for adjusting the vertical position of the tank means with respect to the housing means which connects to the flotation section and extends downwardly therefrom.

9. An assembly as defined in claim 1 wherein said reservoir is a swimming pool, and the intermediate suction section includes valve means coupled to the filtration and drain system of the swimming pool for maintaining a suction balance between the assembly and filtration and drain system of the swimming pool, said intermediate suction section being effective to remove impurity-laden liquid from at least the middle half section between the top surface and bottom of the swimming pool.

10. A sweeping assembly for drawing impurity-laden liquid from a reservoir holding a body of such liquid, said assembly comprising:

(a) a flotation section, a surface skimming section, an intermediate suction section and a bottom sweep and suction section, (b) the flotation section incuding floating means for supporting the surface skimming section, the intermediate depth suction section and the bottom sweep and suction section therebelow within the liquid in said reservoir, (c) the surface skimming section including means for removing impurity-laden liquid from the surface of the liquid in said reservoir, (d) the bottom sweep and suction section including means for placing impurities from the bottom of said reservoir in suspension within said liquid body, (e) the intermediate depth suction section including means for drawing impurity-laden liquid from an intermediate location within said liquid body between the top surface and the bottom of the reservoir, (f) housing means extends downwardly from the flotation section to define the surface skimming section, (g) said surface skimming section including a skimmer tank means and a floating weir member rotatably disposed in said skimmer tank means, (h) said floating weir member being effective to promote a secondary surface level within the skimmer tank means and including means for allowing liquid to flow from the body of liquid in the reservoir into the skimmer tank means, (i) said weir member including means for causing rotation of the weir member within the tank means as the liquid flows into the tank means.

11. An assembly as defined in claim 10 wherein the floating weir member includes a centrally located float portion which provides buoyancy within the skimmer tank means and an annular flange member radially spaced from the central float portion and effective to extend over the circumferential edge of the skimmer tank means, the action of the weir member being effective to maintain a differential surface level between the secondary surface in the skimmer tank means and the surface of the liquid body in the reservoir in which the assembly is disposed, said weir member also being effective to preclude aeration of the intermediate suction section by maintaining a constant prime within the skimmer tank means.

12. An assembly as defined in claim 10 wherein the flotation section includes means for controlling the upward movement of the weir member within the skimmer tank means.

13. An assembly as defined in claim 10 wherein the weir member includes offset openings circumferentially placed around the upper edge of an outer annular wall, each of said offset openings having an access indentation extending in a direction transverse to the radius of the weir member and being effective to allow for uniform flow of liquid from outside the weir member into the skimmer tank means, the movement of liquid through the cavity access indentations being effective to rotate the floating weir member continuously thereby maintaining weir balance and oscillatory action of the weir member thereby preventing hang-up thereof.

14. A sweeping assembly for drawing impurity-laden liquid from a reservoir holding a body of such liquid, said assembly comprising:

(a) a flotation section, a surface skimming section, an intermediate suction section and a bottom sweep and suction section, (b) the flotation section including floating means for supporting the surface skimming section, the intermediate depth suction section and the bottom sweep and suction section therebelow within the liquid in said reservoir, (c) the surface skimming section including means for removing impurity-laden liquid from the surface of the liquid in said reservoir, (d) the bottom sweep and suction section including means for placing impurities from the bottom of said reservoir in suspension within said liquid body, (e) the intermediate depth suction section including means for drawing impurity-laden liquid from an intermediate location within said liquid body between the top surface and the bottom of the reservoir, (f) the assembly has a longitudinal axis which extends downwardly from said floating means, and (g) said stabilizing means includes plate means which extends outwardly in a direction normal to said longitudinal axis.

15. An assembly as defined in claim 4 wherein said floating means includes a plurality of hollow float members extending downwardly from the platform means, the bottom portion of the platform means includes support sleeves having an abutment means on the inside thereof to contact a float member rotatably mounted therein, each said float member having a cambered edge communicating with said support sleeve abutment means and being effective to adjust the position of each float member with respect to the platform means upon rotation of the float member within said support sleeve.

16. A sweeping assembly for drawing impurity-laden liquid from a reservoir holding a body of such liquid, said assembly comprising:

(a) a flotation section, a surface skimming section, an intermediate suction section and a bottom sweep and suction section, and (b) the flotation section including floating means for supporting the surface skimming section, the intermediate depth suction section and the bottom sweep and suction section therebelow within the liquid in said reservoir, (c) the surface skimming section including means for removing impurity-laden liquid from the surface of the liquid in said reservoir, (d) the bottom sweep and suction section including means for placing impurities from the bottom of said reservoir in suspension within said liquid body, (e) the intermediate depth suction section including means for drawing impurity-laden liquid from an intermediate location within said liquid body between the top surface and the bottom of the reservoir, (f) the surface skimming section includes a skimmer tank means having openings located therein to direct liquid from the surface skimming section to the intermediate depth section section, (g) housing means defining said surface skimming section and intermediate depth suction section.

17. An assembly as defined in claim 16 wherein said skimmer tank means includes means for adjusting the size of the openings innerconnecting the skimmer tank means and the intermediate depth suction section.

18. An assembly as defined in claim 16 wherein said skimmer tank means includes chambered, T-connector means having aperture means for directing liquid from the skimmer tank means into the intermediate suction section and being effective to control the operation of the surface skimming section.

19. A method of removing impurities from liquid contained in a reservoir, said method comprising the steps of:

(a) causing impurities to be maintained in suspension within the liquid, (b) removing impurity-laden liquid from a location in at least a middle half section between the top surface and bottom of the liquid in the reservoir, (c) extracting the impurities from the liquid, and (d) returning the liquid to the reservoir after said extracting step.

20. A method as defined in claim 19 wherein impurity-laden liquid is removed from the top surface and at the bottom of the liquid at the same time that such liquid is removed from said middle half section between the top surface and the bottom of the liquid.

21. An assembly for removing impurities from liquid contained in a reservoir, said assembly comprising:

(a) means for causing impurities to be maintained in suspension within the liquid, and (b) means for removing impurity-laden liquid from a location in at least a middle half section between the top surface and bottom of the liquid reservoir, (c) extracting the impurities from the liquid, and (d) returning the liquid to the reservoir after said extracting step.

22. An assembly as defined in claim 21 wherein said removing means includes surface skimming means for removing impurity-laden liquid from the top surface of the liquid and bottom suction means for removing impurity-laden liquid from the bottom of the reservoir, said surface skimming means and bottom suction means being effective to remove impurity-laden liquid simultaneously with the removal of impurity-laden liquid from said middle half section between the top surface and the bottom of the liquid body.

* * * * *